US010297951B2

(12) United States Patent
Zhao et al.

(10) Patent No.: US 10,297,951 B2
(45) Date of Patent: May 21, 2019

(54) CONNECTOR WITH LATCH

(71) Applicant: Micro Motion, Inc., Boulder, CO (US)

(72) Inventors: Heng Zhao, Nanjing (CN); Hua Jiang, Nanjing (CN); Xue Zi, Nanjing (CN)

(73) Assignee: Micro Motion, Inc., Boulder, CO (US)

( * ) Notice: Subject to any disclaimer, the term of this patent is extended or adjusted under 35 U.S.C. 154(b) by 0 days.

(21) Appl. No.: 15/502,562

(22) PCT Filed: Sep. 3, 2014

(86) PCT No.: PCT/CN2014/085841
§ 371 (c)(1),
(2) Date: Feb. 8, 2017

(87) PCT Pub. No.: WO2016/033757
PCT Pub. Date: Mar. 10, 2016

(65) Prior Publication Data
US 2017/0222362 A1 Aug. 3, 2017

(51) Int. Cl.

| | |
|---|---|
| ***H01R 12/57*** | (2011.01) |
| ***H01R 13/04*** | (2006.01) |
| ***H01R 13/50*** | (2006.01) |
| ***H01R 43/20*** | (2006.01) |
| ***H01R 13/627*** | (2006.01) |

(52) U.S. Cl.
CPC ..... *H01R 13/6272* (2013.01); *H01R 13/04* (2013.01); *H01R 13/501* (2013.01); *H01R 43/20* (2013.01); *H01R 12/57* (2013.01)

(58) Field of Classification Search
CPC ..... H01R 13/501; H01R 13/6271; H01R 13/6272; H01R 13/04; H01R 12/57; H01R 43/20
See application file for complete search history.

(56) References Cited

U.S. PATENT DOCUMENTS 4,109,989 A * 8/1978 Snyder, Jr. ..... G02B 6/3849 439/140
5,015,199 A 5/1991 Hirano et al.
5,104,253 A 4/1992 Zielinski et al.
(Continued)

FOREIGN PATENT DOCUMENTS

CN 201142451 Y 10/2008
CN 201204271 Y 3/2009
(Continued)

*Primary Examiner* — Edwin A. Leon
*Assistant Examiner* — Oscar C Jimenez
(74) *Attorney, Agent, or Firm* — The Ollila Law Group LLC

(57) ABSTRACT

A connector (100) is provided. The connector (100) includes a connector body (110) with a connector axis (X), the connector body (110) being comprised of an interface (112) at a first distal end (110*a*) of the connector body (110), an opening (114) at a second distal end (110*b*) of the connector body (110), and a conduit (116) extending from the interface (112) to the opening (114) along the connector axis (X). The connector (100) also includes a latch (120) that moves relative to the connector body (110) to selectively engage a plug connector (200), the latch (120) being comprised of a pivot end (122) coupled to the connector body (110), a manually operable end (124), and a latching feature (126) disposed between the pivot end (122) and the manually operable end (124).

22 Claims, 7 Drawing Sheets

(56) References Cited

U.S. PATENT DOCUMENTS 5,302,141 A * 4/1994 O'Reilly ..... B60D 1/64 439/144
5,830,000 A 11/1998 Shifflett et al.
5,938,470 A * 8/1999 Kashiyama ..... H01R 13/6275 439/357
5,944,549 A 8/1999 Po et al.
6,007,362 A * 12/1999 Davis ..... H01R 13/6272 439/358
6,054,779 A * 4/2000 Zubko ..... B60Q 1/305 307/10.8
6,126,474 A 10/2000 Doye et al.
6,193,540 B1 * 2/2001 Tseng ..... F21V 19/0005 362/653
6,450,833 B1 * 9/2002 Brown, Jr. ..... B60D 1/64 439/518
6,902,420 B2 * 6/2005 Muro ..... H01R 13/6272 439/358
7,229,306 B2 * 6/2007 Mase ..... H01R 13/6272 439/354
7,318,739 B2 * 1/2008 Abe ..... H01R 13/6272 439/350
7,607,927 B2 * 10/2009 Kim ..... H01R 13/5227 439/206
7,621,771 B2 * 11/2009 Petzl ..... H01R 13/405 439/358
9,543,683 B2 * 1/2017 Leonhardt ..... H01R 13/436
2002/0111060 A1 * 8/2002 Challis ..... H01R 13/6272 439/352
2005/0082840 A1 * 4/2005 Ichida ..... H01R 13/6272 292/66
2009/0156046 A1 6/2009 Chen et al.
2015/0126075 A1 * 5/2015 Chen ..... H01R 13/642 439/678
2016/0226189 A1 * 8/2016 Simonazzi ..... H01R 13/6272

FOREIGN PATENT DOCUMENTS

JP 06236781 A 8/1994
JP 11016635 A 1/1999
JP 2002093526 A 3/2002
JP 2002522874 A 7/2002
WO 0008589 A1 2/2000

* cited by examiner

CONNECTOR WITH LATCH

TECHNICAL FIELD

The embodiments described below relate to connectors and, more particularly, to a connector with a latch.

BACKGROUND

Electrical assemblies often employ housings to protect internal components such as circuit boards, cables, and displays. The internal components may be required to communicate, for example, electrically with other devices or components that are outside of the housing. Feedthrough connectors are typically affixed to the housing and have one or more conductors that go through a wall of the housing. The conductor is coupled to the internal components so the internal components can communicate with the devices or components outside of the housing. The conductor can also be electrically isolated from the housing with ceramic such as a potting material.

Many feedthrough connectors are readily available from various suppliers. However, the readily available connectors are not necessarily well suited for electrical assemblies with proprietary internal components or limited design options due to regulatory or environmental constraints. For example, some electrical assemblies may be required to meet 'explosion proof' regulations. As a result, the housing and internal components may have robust design structures such as thick walls, reinforcing members, rigid structures, or the like. The thick walls and reinforcing members may limit the envelope size available for the readily available connectors. In addition, servicing these electrical devices may necessarily be done in uncontrolled environments where the user servicing the electrical device employs gloves, inappropriate tools, or other objects to replace, upgrade, or otherwise disassemble and service the electrical assemblies.

Such issues can lead to damaged electrical assemblies or other devices as well as extended service times. For example, the readily available connectors might employ inexpensive designs that may be appropriate for non-industrial applications, but are prone to failure when exposed to uncontrolled environments. Connectors with form factors that are inappropriate for their intended envelopes can be difficult to access, thereby causing extended service times. Extended service times can be unacceptable in many industries with high capital investments where equipment downtime is prohibitively expensive. In addition, the limited access can induce the operator to use unorthodox methods in attempting to reduce the service time. These unorthodox methods may have a higher likelihood of damaging the electrical assemblies.

Some of the readily available connectors might be suitable in some limited industrial applications, but are typically complex. For example, the connectors might employ metal housings with captured and inaccessible bearing and spring retention mechanisms. Latches can overcome some of the complexities associated with bearing and spring retention mechanisms. However, the latches are inaccessible and are employed in complex connector designs. The complex connectors require prohibitively expensive manufacturing processes and are more prone to failure when exposed to corrosion, contaminants, or extreme temperatures. In addition, complex connectors may not fit within a wide variety of limited envelope sizes without significant redesign costs.

Accordingly, there is a need for a connector with a latch that can be inexpensive to manufacture, suitable for industrial applications, and fit within small envelope sizes while being accessible.

SUMMARY

A connector is provided. According to an embodiment, the connector comprises a connector body with a connector axis, the connector body being comprised of an interface at a first distal end of the connector body, an opening at a second distal end of the connector body, and a conduit extending from the interface to the opening along the connector axis. The connector further comprises a latch that moves relative to the connector body to selectively engage a plug connector, the latch being comprised of a pivot end coupled to the connector body, a manually operable end, and a latching feature disposed between the pivot end and the manually operable end.

A method of using a connector is provided. According to an embodiment, the method comprises providing a connector body with a connector axis, the connector body being adapted to receive a plug connector in a direction substantially parallel with the connector axis. The method further comprises providing a latch comprised of a pivot end coupled to the first distal end of the connector body, a manually operable end, and a latching feature disposed between the pivot end and the manually operable end. The method further comprises manually operating the latch to selectively engage the latch with a plug connector in the connector body.

A method of forming a connector is provided. According to an embodiment, the method comprises forming a connector body adapted to receive a plug connector in a direction substantially parallel to a connector axis of the connector body. The method further comprises forming a latch comprised of a pivot end coupled to the connector body, a manually operable end, and a latching feature disposed between the pivot end and the manually operable end, wherein at least a portion of the connector body and at least a portion of the latch are formed as a single integral piece of material that is adapted to elastically deform when the latch moves relative to the connector body.

ASPECTS

According to an aspect, a connector(100) comprises a connector body (110) with a connector axis (X), the connector body (110) being comprised of an interface (112) at a first distal end (110*a*) of the connector body (110), an opening (114) at a second distal end (110*b*) of the connector body (110), and a conduit (116) extending from the interface (112) to the opening (114) along the connector axis (X), a latch (120) that moves relative to the connector body (110) to selectively engage a plug connector (200), the latch (120) being comprised of a pivot end (122) coupled to the connector body (110), a manually operable end (124), and a latching feature (126) disposed between the pivot end (122) and the manually operable end (124).

Preferably, the latch (120) is pivotable about the pivot end (122) when a force is applied to the manually operable end (124).

Preferably, the latch (120) is adapted to selectively engage the plug connector (200) with the latching feature (126).

Preferably, the latch (120) moves the latching feature (126) into or out of the connector body (110) to selectively engage the plug connector (200).

Preferably, the latch (120) has a latch length (Y) extending from the pivot end (122) to the manually operable end (124), wherein the latch length (Y) is substantially parallel to the connector axis (X) of the connector body (110).

Preferably, the connector (100) further comprises a brace (130) comprised of a base end (132) coupled to the first distal end (110*a*) of the connector body (110), and a bracing end (134) that is proximate the manually operable end (124) of the latch (120).

Preferably, the brace (130) further comprises a brace length (Z) extending from the base end (132) and the bracing end (134), where the brace length (Z) is substantially parallel to the connector axis (X) of the connector body (110).

Preferably, the brace (130) limits the movement of the latch (120) to ensure that the latch (120) only elastically deforms.

Preferably, the connector body (110) further comprises a groove (116*a*) formed in the connector body (110).

Preferably, the connector (100) further comprises a plate (140) coupled to the first distal end (110*a*) of the connector body (110) and the pivot end (122) of the latch (120), the plate (140) comprising a surface (W) that is substantially perpendicular to the connector axis (X).

Preferably, at least a portion of the connector body (110) and at least a portion of the latch (120) are formed as a single integral piece of material.

According to an aspect, a method of using a connector (100) comprises providing a connector body (110) with a connector axis (X), the connector body (110) being adapted to receive a plug connector (200) in a direction substantially parallel with the connector axis (X); providing a latch (120) comprised of a pivot end (122) coupled to the first distal end (110*a*) of the connector body (110), a manually operable end (124), and a latching feature (126) disposed between the pivot end (122) and the manually operable end (124); and manually operating the latch (120) to selectively engage the latch (120) with a plug connector (200) in the connector body (110).

Preferably, manually operating the latch (120) comprises pivoting the latch (120) about the pivot end (122) by applying a force to the latch (120).

Preferably, manually operating the latch (120) comprises moving the latching feature (126) into or out of the connector body (110) to selectively engage the plug connector (200).

Preferably, manually operating the latch (120) comprises pressing the plug connector (200) against the latching feature (126).

Preferably, manually operating the latch (120) comprises pressing against the manually operable end (124) of the latch (120).

Preferably, the connector (100) further comprises providing a brace (130) coupled to the connector body (110), wherein the brace (130) comprises a bracing end (134) that is proximate the manually operable end (124) of the latch (120), wherein the operator braces against the bracing end (134) while pressing against the manually operable end (124) of the latch (120).

Preferably, the operator moves the latch (120) towards the brace (130) until the brace (130) stops the movement of the latch (120) to ensure that the latch (120) only elastically deforms.

Preferably, pivoting the latch (120) about the pivot end (122) comprises utilizing the elasticity of the latch (120) to move the latching feature (126) towards the connector body (110).

Preferably, moving the latching feature (126) to engage the plug connector (200) retains the plug connector (200) within the connector body (110).

According to an aspect, a method of forming a connector (100) comprises forming a connector body (110) adapted to receive a plug connector (200) in a direction substantially parallel to a connector axis (X) of the connector body (110), and forming a latch (120) comprised of a pivot end (122) coupled to the connector body (110), a manually operable end (124), and a latching feature (126) disposed between the pivot end (122) and the manually operable end (124), wherein at least a portion of the connector body (110) and at least a portion of the latch (120) are formed as a single integral piece of material that is adapted to elastically deform when the latch (120) moves relative to the connector body (110).

Preferably, the method further comprises forming a brace (130) with a base end (132) that is coupled to the connector body (110), and a bracing end (134) that is proximate the manually operable end (124) of the latch (120), wherein at least a portion of the brace (130), the at least the portion of the latch (120), and the at least the portion of the connector body (110) are formed as the single integral piece of material.

Preferably, forming the connector body (110) comprises forming an interface (112) at a first distal end (110*a*) of the connector body (110), wherein the interface (112) and the at least the portion of the connector body (110) are formed as a single integral piece of material.

Preferably, forming the interface (112) comprises encapsulating at least a portion of a pin (150) that extends through the interface (112).

Preferably, the method further comprises forming a plate (140) with a surface (W) that is substantially perpendicular to the connector axis (X), with at least a portion of the plate (140) being formed as a single integral piece of material with the connector body (110).

BRIEF DESCRIPTION OF THE DRAWINGS

The same reference number represents the same element on all drawings. It should be understood that the drawings are not necessarily to scale.

DETAILED DESCRIPTION

FIGS. 1-7 and the following description depict specific examples to teach those skilled in the art how to make and use the best mode of embodiments of a connector with a latch. For the purpose of teaching inventive principles, some conventional aspects have been simplified or omitted. Those skilled in the art will appreciate variations from these examples that fall within the scope of the present description. Those skilled in the art will appreciate that the features described below can be combined in various ways to form multiple variations of the connector with the latch. As a result, the embodiments described below are not limited to the specific examples described below, but only by the claims and their equivalents.

Figure 1:
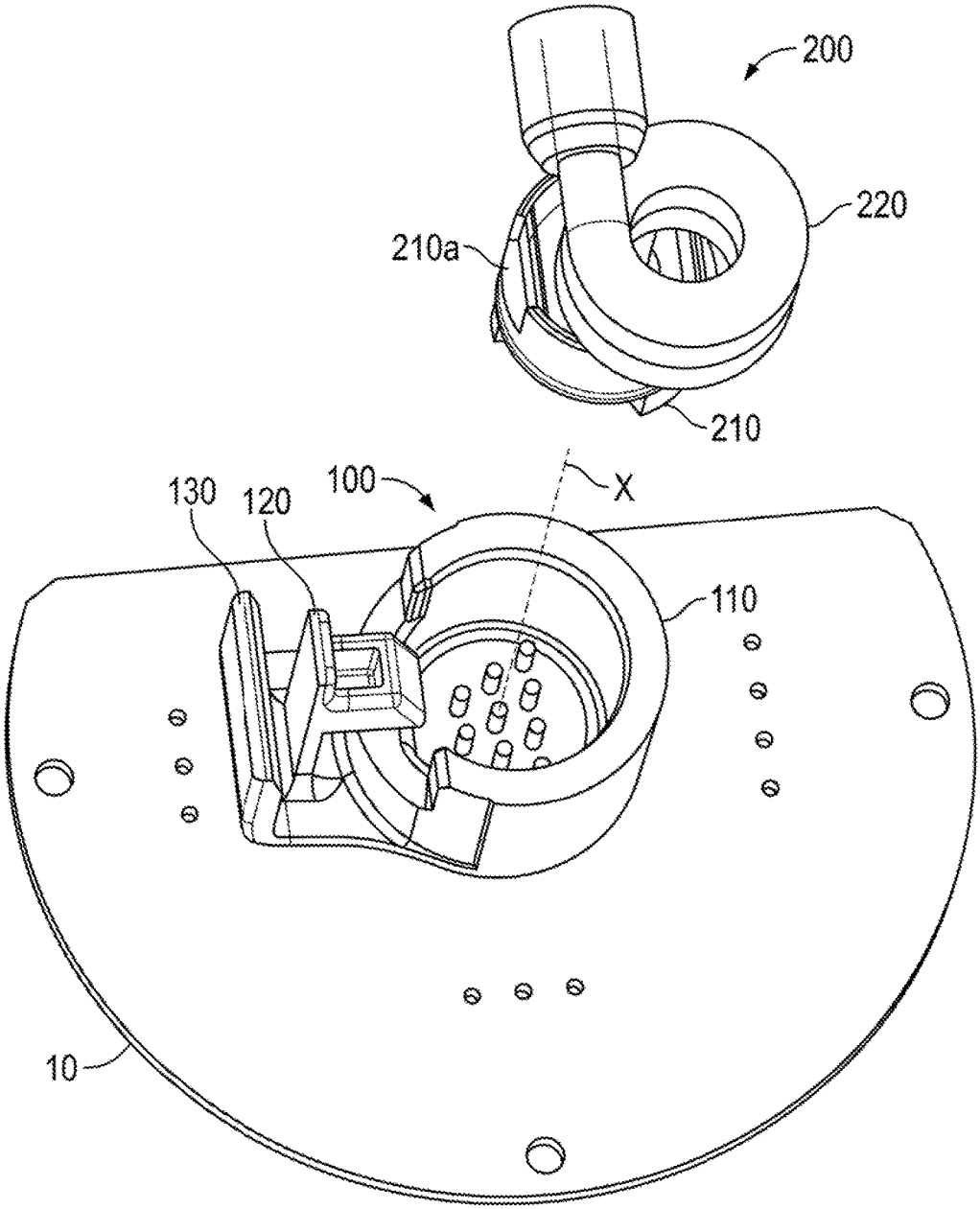
FIG. 1 shows a perspective view of a connector 100 in proximity with a plug connector 200 according to an embodiment.

FIG. 1 shows a perspective view of a connector 100 in proximity with a plug connector 200 according to an embodiment. As shown, the connector 100 is coupled to a circuit board 10. The plug connector 200 is shown as disconnected from the connector 100. The connector 100 is shown as being comprised of a connector body 110 and a latch 120. In the embodiment shown, the latch 120 is coupled to the connector body 110. Also shown is a brace 130 that is coupled to the connector body 110. As will be described in more detail in the following, the plug connector 200 can be selectively coupled to the connector 100 with the latch 120. As shown in FIG. 1, the plug connector 200 includes a plug body 210 with a notch 210*a*. The plug body 210 is coupled to a cable 220, which may carry a signal, such as an electrical signal, to devices outside of a housing (not shown).

When the plug connector 200 is selectively coupled with the connector 100, the plug connector 200 may move substantially parallel with the connector axis X. In the embodiment shown, the connector body 110 is adapted to receive the plug connector 200 in a direction that is substantially parallel with the connector axis X. That is, when the plug connector 200 moves towards the connector 100 parallel to the connector axis X, the plug connector 200 can couple with the connector 100. The plug connector 200 can move away from the connector 100 along the connector axis X and decouple from the connector 100. Other embodiments can employ alternative movements to selectively couple the connector 100 and a plug connector 200.

As shown in FIG. 1, the connector 100 is disposed between the circuit board 10 and the plug connector 200. The plug connector 200 is displaced away from the connector 100. From the displaced position, an operator (not shown) can press the plug connector 200 into the connector body 110 to form an electrical connection between the plug connector 200 and the circuit board 10. As can be appreciated, the plug connector 200 can move the latch 120 as the plug connector 200 is inserted into the connector body 110. Additionally or alternatively, the operator can move the latch 120 away from the connector body 110 by pressing against the latch 120.

When the plug connector 200 is coupled with the connector body 110, the latch 120 can retain the plug connector 200 in the connector 100. In the embodiment shown, the latch 120 can engage with the plug connector 200 when the plug connector is fully inserted into the connector body 110. However, in alternative embodiments, the plug connector 200 may not be fully inserted into the connector body 110 when the latch 120 engages with the plug connector 200. In these and other embodiments, the latch 120 may engage with the notch 210*a* on the plug body 210, as will be described in more detail in the following with reference to FIG. 7. Accordingly, the latch 120 may prevent the plug connector 200 from being decoupled from the connector 100.

To remove the plug connector 200, the operator may manually operate the latch 120 to, for example, disengage the latch 120 from the plug connector 200. The operator can also apply a force against the brace 130 to make applying the force to the latch 120 easier. For example, the operator can place a thumb on the brace 130 and a finger on the latch 120. To apply the force to the latch 120, the operator can squeeze the latch 120 and the brace 130 by pinching the finger and thumb. Accordingly, the plug connector 200 may be decoupled from the connector 100.

Moving the latch 120 relative to the connector body 110 can engage or disengage the latch 120 from the plug connector 200. In the embodiment shown, moving the latch 120 towards the connector body 110 can engage the latch 120 with the plug connector 200. Moving the latch 120 away from the connector body 110 can disengage the latch from the plug connector 200. Moving the latch 120 relative to the connector body 110 can include moving the latch 120 into or out of the connector body 110.

Moving the latch 120 into the connector body 110 can selectively engage the latch 120 with the plug connector 200. The operator or the plug connector 200 can move the latch 120 into the connector body 110 by applying the force to portions of the latch 120. Additionally or alternatively, the latch 120 may move into the connector body 110 due to other forces. Moving the latch 120 out of the connector body 110 can disengage the latch 120 from the plug connector 200. These and other features of selectively engaging the latch 120 with the plug connector 200 are described in more detail in the following.

Figure 2:
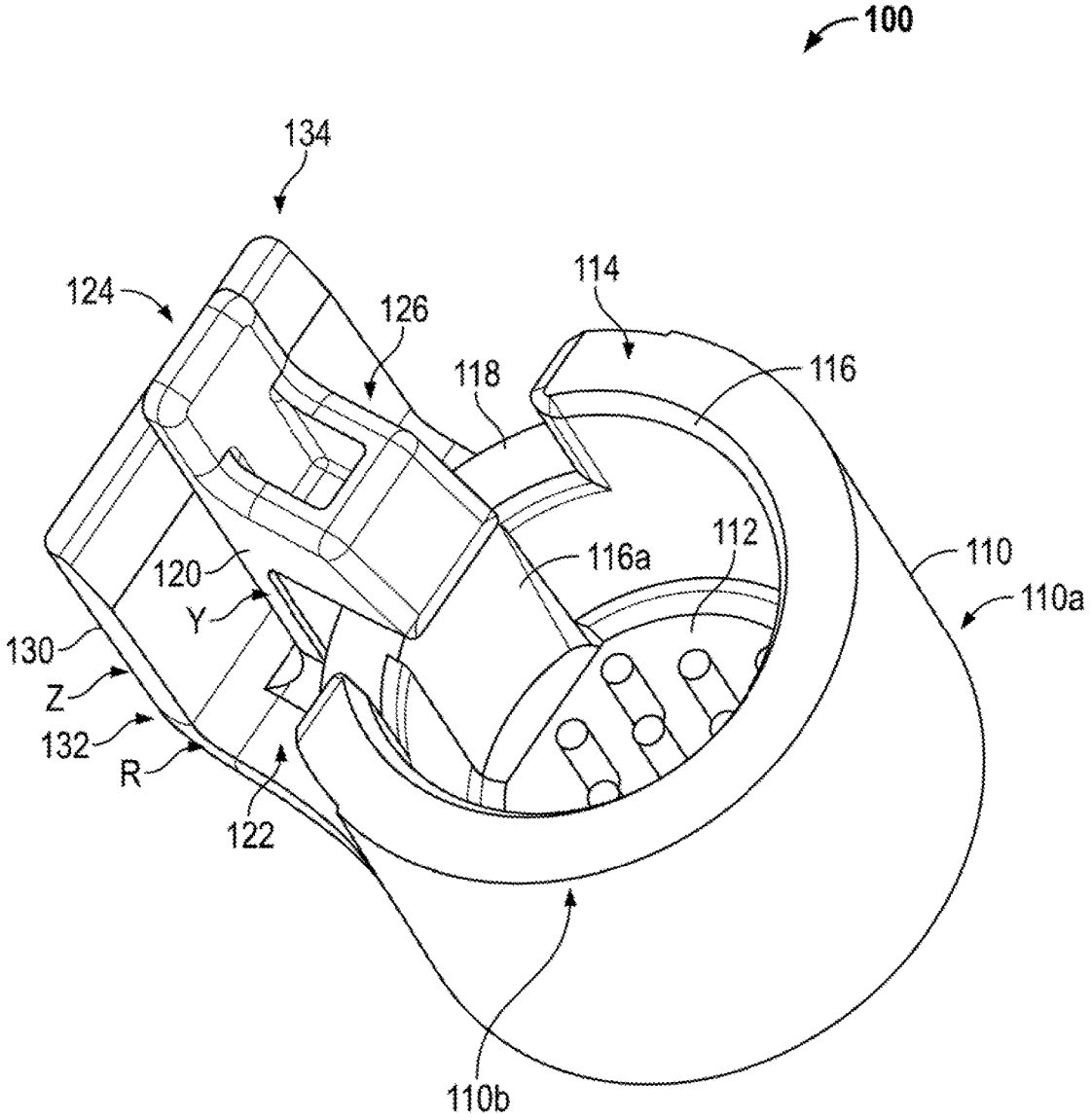
FIG. 2 shows a perspective view of the connector 100 without the circuit board 10 and the plug connector 200 for clarity.

FIG. 2 shows a perspective view of the connector 100 without the circuit board 10 and the plug connector 200 for clarity. As shown, the connector 100 includes the connector body 110, the latch 120, and the brace 130 described with reference to FIG. 1. As discussed in the foregoing, the connector body 110 can receive the plug connector 200 to form an electrical connection between, for example, the circuit board 10 and devices outside of an electrical assembly.

Accordingly, the connector body 110 can be adapted to couple to the circuit board 10 or other components, such as internal components of an electrical assembly, at a first distal end 110*a*. As shown, an interface 112 is at the first distal end 110*a*. The interface 112 is shown as being part of the connector body 110. However, in alternative embodiments, the interface 112 may be formed as part of, for example, the circuit board 10. In these alternative embodiments, the circuit board 10 can be coupled to the connector body 110 at an opening that is at the first distal end 110*a*. In other embodiments, the interface 112 can be formed by, for example, terminals on a cable assembly or the like, which can be coupled to the connector body 110.

In the embodiment shown, the connector body 110 also includes an opening 114 at the second distal end 110*b*. The opening 114 can be adapted to receive the plug connector 200 described with reference to FIG. 1. The connector body 110 also includes a conduit 116 that extends from the opening 114 at the second distal end 110*b* to the first distal end 110*a*. The conduit 116 is shown as extending along the connector axis X. The connector body 110 is shown as having a substantially cylindrical shape that is concentrically arranged about the connector axis X, although any suitable shape and arrangement can be employed. A groove 116*a* is formed in the conduit 116 that extends through the interface 112. A cutout 118 is formed in the connector body 110 that exposes a portion of the plug connector 200 to the latch 120 when the plug connector 200 is in the connector body 110.

The latch 120 is shown as including a pivot end 122 that is coupled to the connector body 110 at the first distal end 110*a*. However, in alternative embodiments, the pivot end 122 can be coupled to the connector body 110 at other locations of the connector body 110. The latch 120 also includes a manually operable end 124. Disposed between the pivot end 122 and the manually operable end 124 is a latching feature 126. The latching feature 126 extends from the latch 120. In alternative embodiments, the latching feature 126 may not extend from the latch 120 and may by a groove, cutout, or any other appropriate feature. In the embodiment shown, the latching feature 126 extends into the connector body 110.

The latching feature 126 being disposed between the pivot end 122 and the manually operable end 124 can allow the manually operable end 124 to be sized to be operable by an operator's finger. For example, a distance between a distal tip of the manually operable end 124 and the latching feature 126 can be about the size of an operator's finger. Accordingly, the operator can move the latch 120 with relative ease. When moving the latch 120, the operator can also press against the brace 130.

The brace 130 is shown as including a base end 132 that is coupled to the connector body 110 at the first distal end 110*a* of the connector body 110. The brace 130 also includes a bracing end 134. The brace 130 is shown as having an L-shape although any suitable shape may be employed. In addition, the brace 130 includes an arcuate section with a bend radius R that may improve the strength, rigidity, and durability of the brace 130. In alternative embodiments, the brace 130 may include other features such as trusses, ribs, or the like that improve the strength, rigidity, and durability of the brace 130 to prevent or limit the deformation of the brace 130 when the operator presses against the bracing end 134.

The bracing end 134 can be sized and positioned for the operator. For example, the width of the bracing end 134 can be about the width of the operator's thumb. The distance between the base end 132 and the bracing end 134 can be selected such that the force applied by the operator to the brace 130 is not sufficient to substantially deform the brace 130. Additionally or alternatively, the distance between the bracing end 134 and the manually operable end 124 of the latch 120 can be selected to be appropriate for the typical operator. For example, the distance between the manually operable end 124 and the bracing end 134 may be selected such that the typical operator is able to access and squeeze the latch 120 and the brace 130.

The connector body 110, the latch 120, and the brace 130 can also be sized and positioned to fit within a variety of small envelopes. For example, the latch length Y of the latch 120 may be sized to fit within a height of an envelope. In this embodiment, the envelope may be sufficient to allow the operators finger to press against the manually operable end 124 to move the latch 120 relative to the connector body 110. Additionally or alternatively, the brace length Z of the brace 130 can be sufficient to allow the operator to press against the bracing end 134 to squeeze the latch 120 and the brace 130, thereby disengaging the latch 120 from the plug connector 200. The foregoing lengths and other dimensions of the connector body 110, the latch 120, and the brace 130 can be sized when the connector 100 is formed.

As shown in FIG. 2, the connector body 110, the latch 120, and the brace 130 include portions that are integrally formed. In the embodiment shown, at least a portion of the connector body 110, the latch 120, and the brace 130 are formed as a single integral piece. In alternative embodiments, the connector body 110, the latch 120, and the brace 130 may not be integrally formed. For example, the latch 120 may be coupled to an intervening piece of material that is not integrally formed with the latch 120. In these and other embodiments, the material may be selected for both the connector body 110 and the latch 120.

The material in the latch 120 may be comprised of material with elastic properties. For example, the latch 120 may be comprised of polymer that is able to elastically deform when the latch 120 is moved relative to the connector body 110. In alternative embodiments, the latch 120 can be comprised of a composite of materials with different properties. In embodiments where the connector body 110 and the latch 120 are formed as a single integral piece of material, the same elastic properties may be present in both the connector body 110 and the latch 120, which can allow the connector body 110 to withstand uncontrolled environments. The material in the connector body 110 can also be employed to encapsulate pins, as will be described in more detail in the following.

Figure 3:
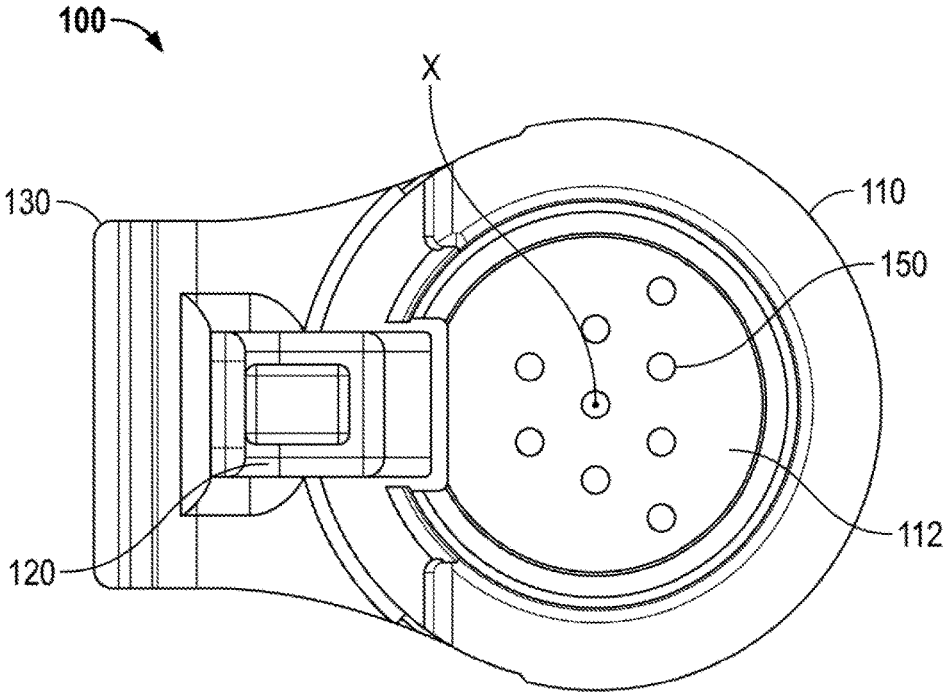
FIG. 3 shows a plan view of the connector 100.

FIG. 3 shows a plan view of the connector 100. As shown, the connector body 110 includes the interface 112 described with reference to FIG. 2. Pins 150 are disposed in the interface 112. Also shown are the latch 120 and the brace 130. In the embodiment shown, the pins 150 are electrical conductors that may be comprised of, for example, a copper alloy. However, in alternative embodiments, any suitable connection means may be employed, such as, for example, fiber optic connections.

The pins 150 are oriented substantially parallel with the connector axis X. However, in alternative embodiments, the pins 150 may not be substantially parallel with the connector axis X. Additionally or alternatively, the pins 150 may not extend through the interface 112 into the connector body 110, but may instead terminate flush with or below a surface of the interface 112. For example, the plug connector 200 may employ male pins that interface with female pins in the interface 112. As can also be seen, the pins 150 are arranged with a trapezoidal shape. The trapezoidal arrangement of the pins 150 can help align the connector body 110 and the plug connector 200 when the plug connector 200 is selectively coupled with connector 100. However, any appropriate arrangement of the pins 150 may be employed, including arrangements that do not align the connector body 110 and the plug connector 200.

When forming the connector body 110, the pins 150 can be encapsulated by the material comprising the connector body 110. For example, the connector body 110 and the interface 112 can be formed by injection molding the material around the pins 150. In the embodiment shown, the connector body 110, the latch 120, and the brace 130 are comprised of a single integrated piece of material with elastic properties. These and other embodiments can encapsulate a portion of the pins 150 to hold the pins 150. Additionally or alternatively, the pins 150 can be pressed through the interface 112.

Once disposed in the connector body 110, the pins 150 can be held by the interface 112 so that the pins 150 are not undesirably displaced when the plug connector 200 is selectively coupled to the connector 100. As discussed in the foregoing, when the plug connector 200 is coupled to the connector 100, the latch 120 can selectively engage the plug connector 200 to retain the plug connector 200 in the connector body 110. The latch 120 and the features employed to retain the plug connector 200 in the connector body 110 are described in more detail in the following with reference to FIGS. 4 and 5.

Figure 4:
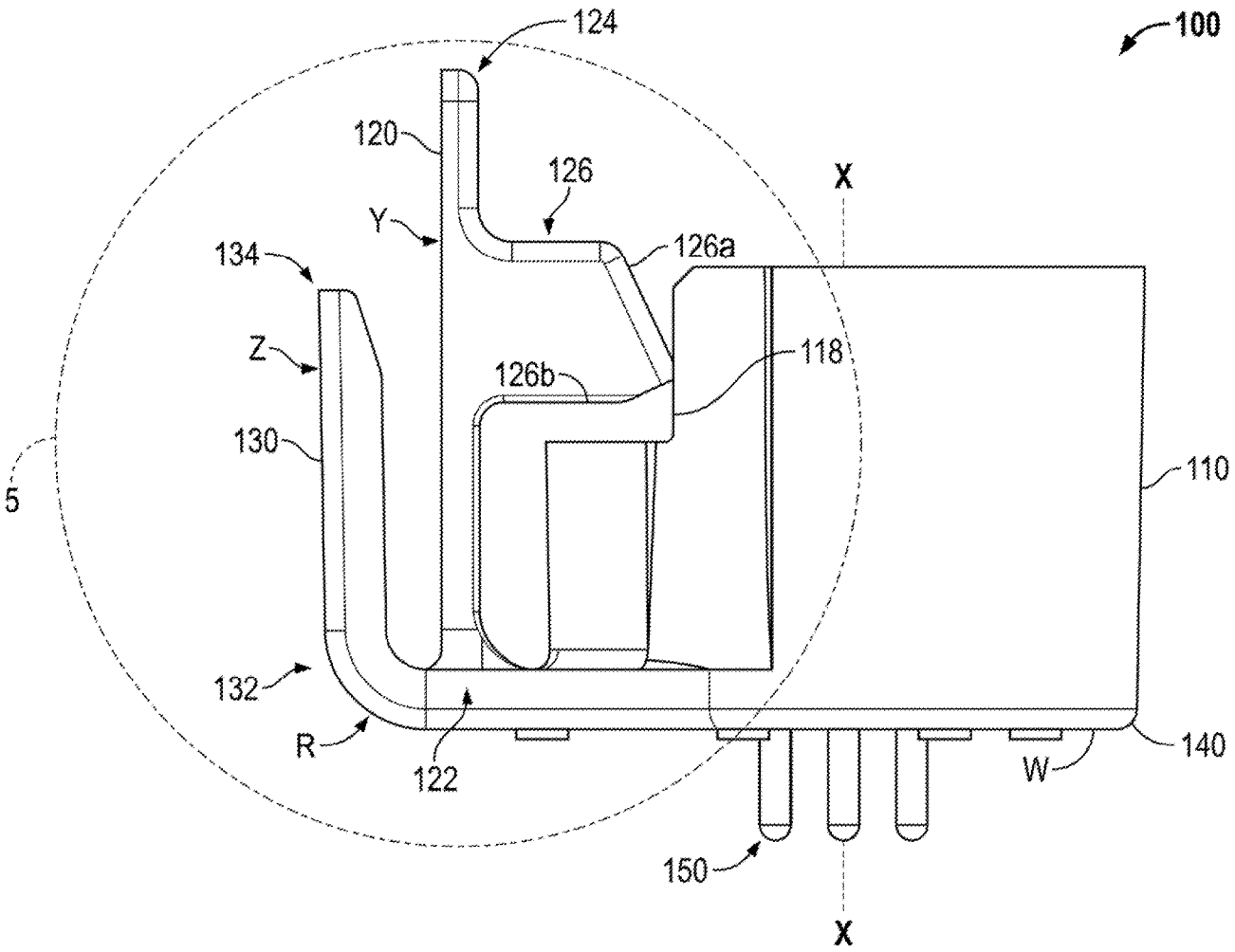
FIG. 4 shows another plan view of the connector 100.

FIG. 4 shows another plan view of the connector 100. The connector 100 is shown as including the connector body 110, the latch 120, and the brace 130. The connector 100 is also shown with the connector axis X. The latch 120 is coupled to the connector body 110 via a plate 140 with a surface W. Also shown are the pins 150 extending through the plate 140. The latch 120 is shown as extending into the connector body 110. Although not shown, the latching feature 126 can selectively engage with the plug connector 200 at the position shown, as will be described in more detail with reference to FIG. 7.

Still referring to FIG. 4, the latch 120 is shown as including the pivot end 122, the manually operable end 124, and the latching feature 126 described with reference to FIG. 2. As can be seen, the manually operable end 124 extends away from the plate 140 in a direction substantially parallel to the connector axis X. The latching feature 126 extends from the latch 120 and into the connector body 110 through the opening formed by the cutout 118. The latching feature 126 is shown as also including a shoulder 126*a* that may be employed to move the latch 120. For example, the plug connector 200 can press against the shoulder 126*a* with a force that moves the latch 120 out of the connector body 110. As described in the foregoing, the latch 120 can also be moved by an operator that presses against the brace 130.

The brace 130 is shown as including the base end 132 and the bracing end 134 described with reference to FIG. 2. The brace 130 is coupled to the plate 140 via the base end 132. The base end 132 is shown as having an arcuate section with the bend radius R, which may increase the strength, stiffness, and durability of the brace 130. The bracing end 134 is proximate the manually operable end 124.

The latch 120 and the brace 130 are shown with the latch length Y and the brace length Z, respectively. In the embodiment shown, the latch length Y and the brace length Z are longitudinal lengths of the respective latch 120 and brace 130. However, in alternative embodiments, the latch length Y and the brace length Z may not be longitudinal lengths. For example, the latch 120 and the brace 130 may be wider than the latch length Y or the brace length Z.

The latch length Y and the brace length Z are also substantially parallel to the connector axis X. However, the connector axis X, the latch length Y, and the brace length Z may not be substantially parallel in alternative embodiments. For example, the brace length Z may have an angle relative to the connector axis X. Additionally or alternatively, the latch length Y may be bent or have a curve. Other orientations and shapes of the latch length Y and the brace length Z may be employed in the same or alternative embodiments.

As can also be seen in FIG. 4, a thickness of the brace 130 is greater than a thickness of the latch 120. The thickness of the latch 120 is the distance between the surface of the latch 120 proximate the connector body 110 and the surface with the latch length Y. Similarly, the thickness of the brace 130 is the distance between the surface of the brace 130 proximate the connector body 110 and the surface with the brace length Z. Due to the different thicknesses, the strength and rigidity of the brace 130 may be greater than the strength and rigidity of the latch 120. Accordingly, the latch 120 may move while the brace 130 does not move, or moves relatively less than the latch 120, when the operator squeezes the latch 120 and the brace 130. As will be described in more detail in the following with reference to FIG. 5, the latch 120 may move relative to the connector body 110 to selectively couple the plug connector 200 to the connector 100.

Figure 5:
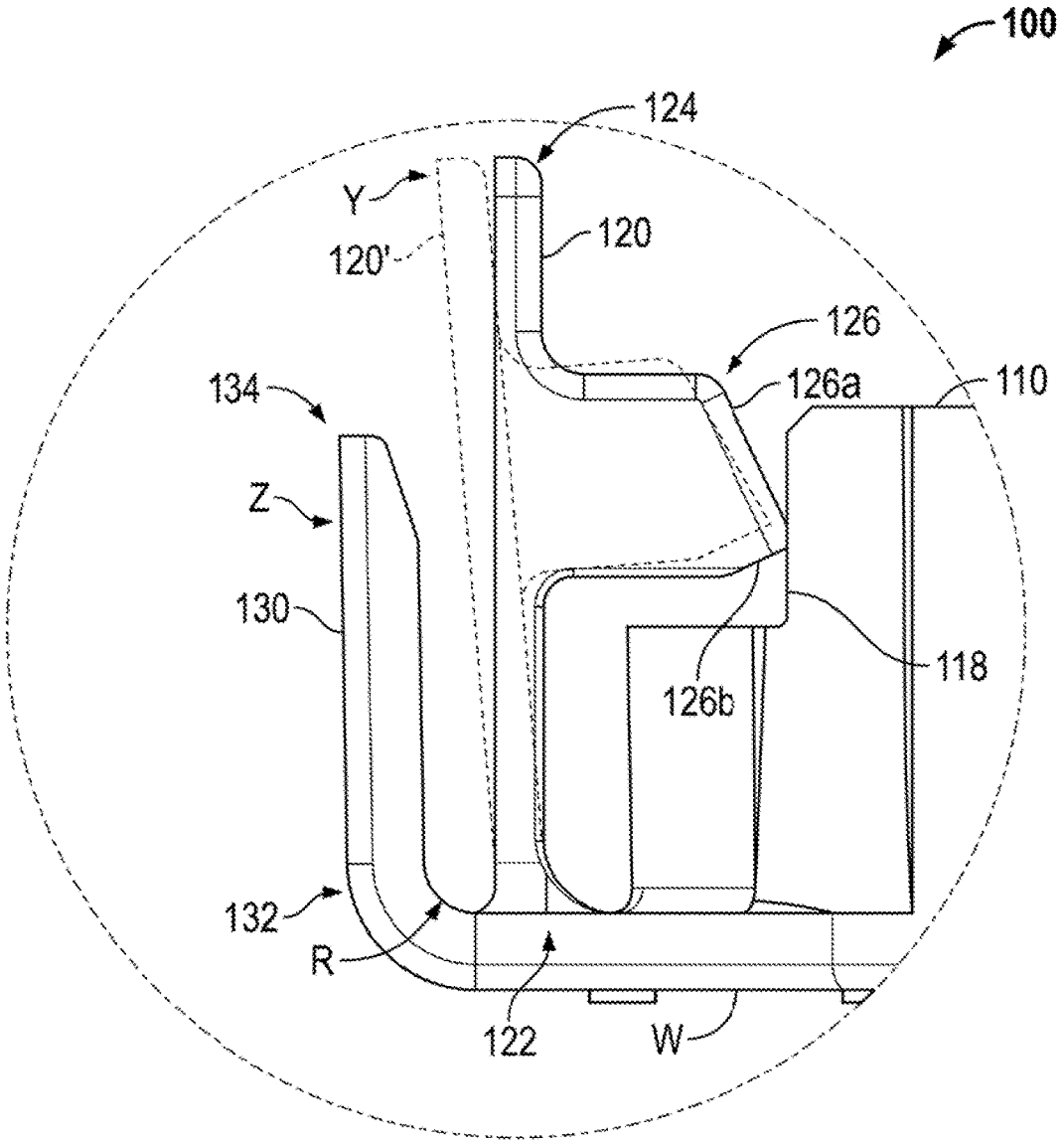
FIG. 5 shows an enlarged partial plan view of the connector 100 shown in FIG. 4.

FIG. 5 shows an enlarged partial plan view of the connector 100 shown in FIG. 4. Only a portion of the connector body 110 is shown for clarity. The latch 120 and the brace 130 are shown in the same position shown in FIG. 4. The latch 120 is shown with the pivot end 122, the manually operable end 124, and the latching feature 126. The latching feature 126 is shown as including the shoulder 126*a* and a chamfer 126*b*. The brace 130 is shown with the base end 132 and the bracing end 134. Also shown, in dashed lines, is a displaced latch 120'.

As can be seen in FIG. 5, the latch 120 can move (e.g., pivot, bend, flex, or the like) about the pivot end 122. For example, the plug connector 200 can press against the shoulder 126*a* to move the latch 120 out of the connector body 110. The plug connector 200 can press against the shoulder 126*a* when the plug connector 200 is inserted into the connector body 110. Additionally or alternatively, the operator may press against the latch 120 at the manually operable end 124 to move the latching feature 126 out of the connector body 110. The plug connector 200 may also press against the chamfer 126*b* on the latch 120 while the plug connector 200 is being pulled out of the connector body 110. The latch 120 may be moved to the displaced latch 120' position shown, although alternative displaced positions may be employed.

As can also be seen in FIG. 5, the displaced latch 120' does not extend into the connector body 110. More particularly, the latching feature 126 does not extend past the cutout 118 and into the connector body 110. The displaced latch 120' can therefore be disengaged from the plug connector 200. Accordingly, the plug connector 200 may move substantially parallel to the connector axis X to, for example, selectively couple with the connector 100. However, in alternative embodiments, the plug connector 200 may move in other directions (e.g., rotate, bend, etc.).

The movement of the latch 120 may be within the elastic range of the material of the connector body 110. As a result, the latch 120 is adapted to elastically deform when the latch 120 moves. For example, when a force is applied to the latch 120 and the latch 120 moves out of the connector body 110, the material can elastically deform. When the force is removed from the latch 120, the elastic properties of the material can return the latch 120 to the position shown in FIG. 4. The movement of the latch 120, due to the elastic properties, can be in addition to a force applied to the latch 120 by, for example, the operator. The elastic properties can be selected along with the range of movement and dimensions of the latch 120 so the connector 100 can selectively couple with the plug connector 200 to form an electrical connection between the pins 150 and the plug connector 200.

Figure 6:
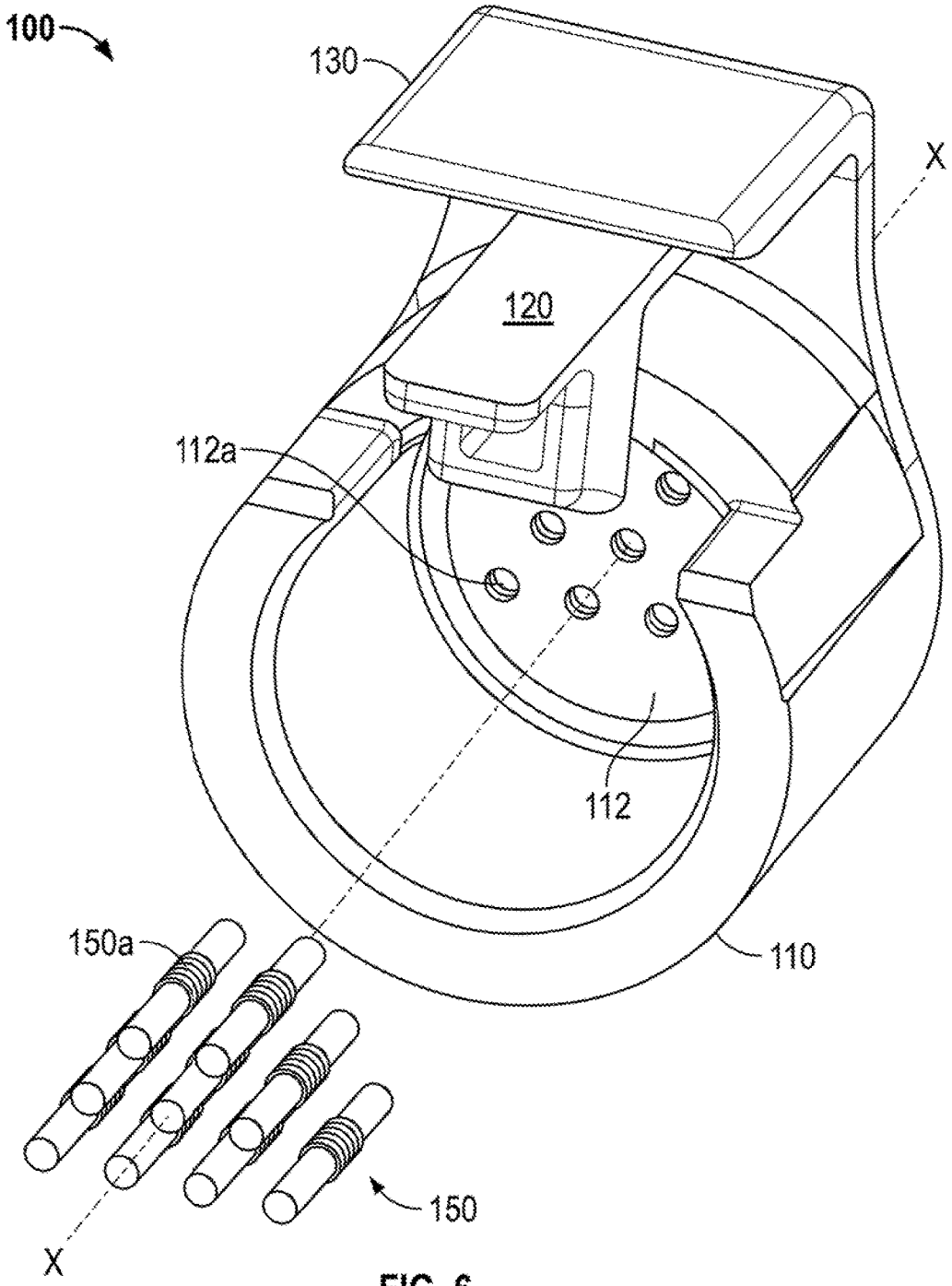
FIG. 6 shows an exploded perspective view of the connector 100 with the pins 150 displaced away from the connector 100.

FIG. 6 shows an exploded perspective view of the connector 100 with the pins 150 displaced away from the connector 100. The connector 100 is shown with the connector body 110, the latch 120, and the brace 130. The pins 150 are shown as displaced away from the interface 112. The interface 112 is shown as including a plurality of pinholes 112*a*. When the connector 100 is assembled, the pins 150 are in the pinholes 112*a*. The pins 150 also include a striated portion 150*a* that can assist in the adhesion of the pins 150 to the connector body 110. In alternative embodiments, the striated portion 150*a* may not be employed or alternative features, such as reticulated surfaces, sectioned pins, or the like, are employed to couple the pins 150 to the connector body 110. As discussed in the foregoing, the pins 150 may form an electrical connection when the connector 100 is selectively coupled to the plug connector 200, as shown in FIG. 7.

Figure 7:
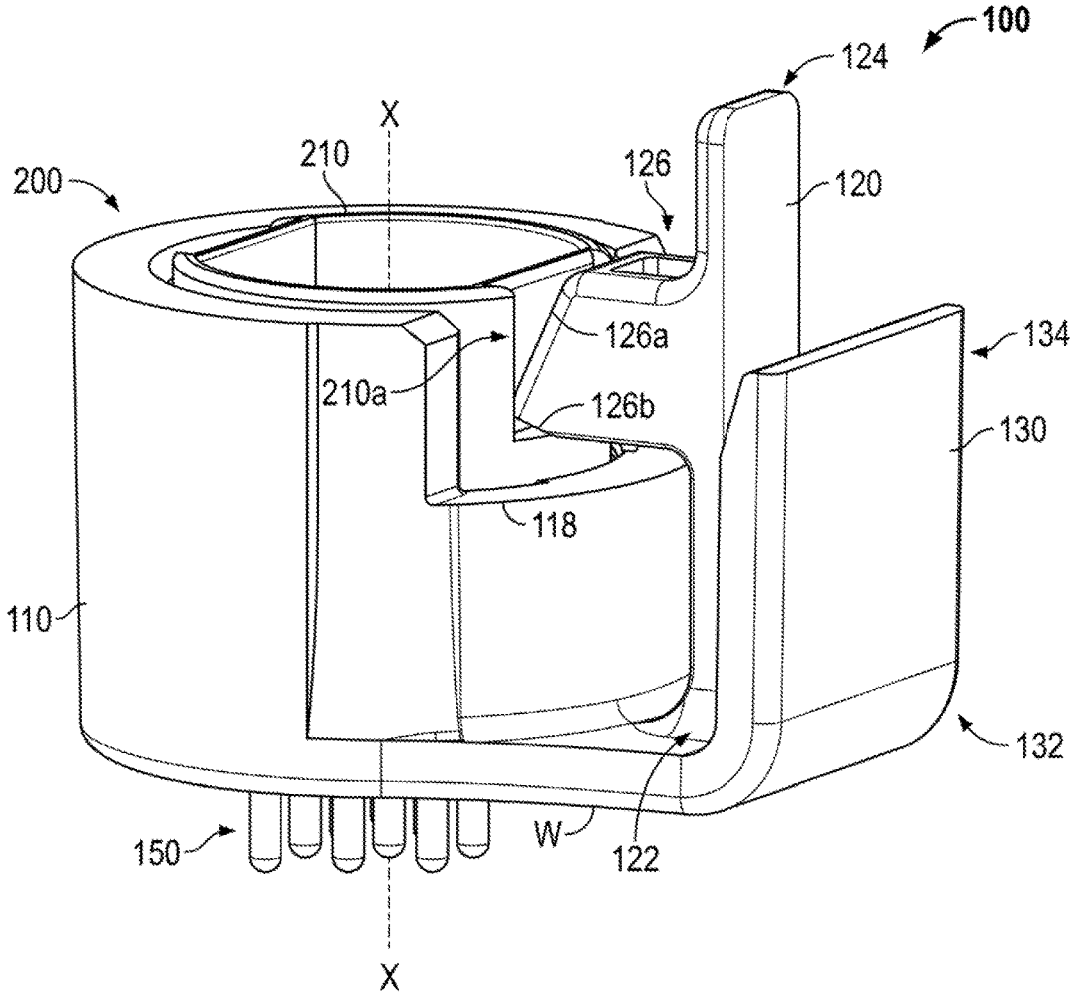
FIG. 7 shows the connector 100 coupled with the plug connector 200.

FIG. 7 shows the connector 100 coupled with the plug connector 200. As shown, the connector 100 includes the connector body 110, the latch 120, and the brace 130. The pins 150 are shown as coupled to the connector body 110 and extending away from the plug connector 200. The connector body 110 is shown with the cutout 118. The latch 120 includes the latching feature 126, which is extended into the connector body 110 through the cutout 118. The latching feature 126 includes the shoulder 126*a* and the chamfer 126*b*. As can be seen, the latching feature 126 is extended into the notch 210*a* and the chamfer 126*b* is interfacing with the notch 210*a*. In particular, the chamfer 126*b* is in contact with the notch 210*a*.

Although not shown, the connector 100 can extend through a panel (not shown). For example, the circuit board 10 could be coupled to the panel with, for example, standoff fasteners. The circuit board 10 could be positioned such that, when the connector 100 is coupled to the standoff fasteners, the connector 100 extends through the panel. The connector body 110, the latch 120, and the brace 130 may therefore be manually operated. For example, the operator could press the plug connector 200 into the connector 100, which moves the latch 120. Once coupled, the latch 120 could move towards the connector body 110 and selectively engage the plug connector 200. Other configurations of the panel and the connector 100 can be employed.

As described in the foregoing, the operator can remove the plug connector 200 from the connector body 110 by disengaging the latch 120 from the plug connector 200. The latch 120 can be disengaged from the plug connector 200 by pressing against the manually operable end 124 of the latch 120. For example, the operator could press the manually operable end 124 towards the brace 130. The latch 120 can move relative to the connector body 110 by, for example, moving about the pivot end 122. As a result, the latch 120 may pivot towards the brace 130. The operator can also press against the bracing end 134 with, for example, the thumb. By doing so, the operator can squeeze the latch 120 and the brace 130. This can improve the ease of disengaging the latch 120 from the plug connector 200.

When the latch 120 has moved away from the plug connector 200 such that the latching feature 126 is no longer extended into the notch 210*a*, the operator can pull on the plug connector 200 in a direction substantially parallel to the connector axis X. As the plug connector 200 moves out of the connector body 110, the plug body 210 may press on the latching feature 126 at the chamfer 126*b*. This can provide a force that can further disengage the latching feature 126 from the plug connector 200. Alternatively, the operator may simply pull on the plug connector 200 to move the latch 120.

In some embodiments, the latch 120 may move out of the connector body 110. For example, to disengage the latching feature 126 from the notch 210*a*, the latching feature 126 may by fully displaced out of the connector body 110 and may not extend through the cutout 118. In these and other embodiments, the plug connector 200 may move in a direction parallel to the connector axis X. When the latch 120 moves relative to the connector body 110, the interface 112 may selectively engage with the plug connector 200. Accordingly, the connector 100 may be selectively coupled with the plug connector 200.

The embodiments described above provide a connector 100 with a latch 120. As explained above, the connector 100 can include a connector body 110 that is relatively compact. In addition, a portion of the connector body 110, the latch 120, and the brace 130 can be formed from a single integral piece of material. The connector 100 can also include pins 150 that are encapsulated by an interface 112 while, for example, the connector body 110 is being molded. Accordingly, the connector 100 can fit into a relatively small envelope and be inexpensive to manufacture.

The latch 120 can include a manually operable end 124 that is readily accessible by the operator to move the latch 120, for example, about the pivot end 122. As a result, the operator can easily move the latch 120 away from the connector body 110 to release the plug connector 200. The latch 120 can also be comprised of material with elastic properties that allow the latch 120 to return to the position that can retain the plug connector 200 without the operator pressing on the latch 120.

The latch 120 can also include a latching feature 126 that extends into the connector body 110. Accordingly, the latching feature 126 can latch onto a feature on the plug connector 200. The latching feature 126 can also include a shoulder 126*a* and a chamfer 126*b*. The shoulder 126*a* and the chamfer 126*b* can engage with a feature on the plug connector 200 while the plug connector 200 is being selectively coupled to the connector body 110. As a result, the plug connector 200 can apply a force to the plug connector 200 to move the latch 120 away from the plug connector 200. For example, the plug connector 200 can be pulled out of the connector body 110 by the operator while the plug connector 200 press against the latch 120 to pivot the latch 120 about the pivot end 122.

Additionally, the connector 100 can include a brace 130 with a bracing end 134 that can be used to assist in the movement of the latch 120. For example, the operator can press his thumb against the brace 130 at the, for example, bracing end 134 to squeeze the brace 130 and the latch 120 to move the latch 120 away from the plug connector 200. The base end 132 may be dimensioned (e.g., radius R, thickness of the brace 130, etc.) so the brace 130 does not substantially deform when the operator presses against the brace 130. Squeezing the latch 120 and the brace 130 may improve the ease with which the latch 120 is pivoted about the pivot end 122.

Features such as the dimensions of the latch 120 and the brace 130 can also be selected to improve the accessibility of the connector 100 for the envelope and ease of use. For example, the thickness of the latch 120 and the brace 130 can be selected so that the latch 120 can be easily moved while the brace 130 retains desired strength and stiffness properties. The width of the latch 120 and the brace 130 can be sized to ensure that the operator's fingers and thumbs can easily move the latch 120 out of the connector body 110. The distance between the manually operable end 124 of the latch 120 and the bracing end 134 on the brace 130 can be proximate thereby ensuring that the operator is able to squeeze the latch 120 and the brace 130. The distance may also limit the amount the latch 120 moves to ensure that the latch 120 only elastically deforms. For example, the latch 120 can be moved until the latch 120 presses against the brace 130. The brace 130 can prevent the latch 120 from moving further.

The connector 100 can also include a plate 140. The plate 140 can be coupled to the connector body 110, the latch 120, and the plate 140. The plate 140 can be formed integrally with the connector body 110, the latch 120, and the brace 130. The plate 140 can be employed to improve the strength and rigidity of the connector 100. The plate 140 can also be adapted to mate with a circuit board 10. The plate 140 can also be molded around the pins 150, which can electrically couple internal components with devices outside a housing.

The material used to form the connector body 110, the latch 120, the brace 130, and the plate 140 can be comprised of a material that is suitable for industrial applications. For example, portions of the connector body 110, the latch 120, the brace 130, and the plate 140 can be formed integrally with plastic that has both elastic properties and corrosion resistance. Accordingly, the latch 120 can repeatedly and reliably engage and disengage from the plug connector 200 even when exposed to uncontrolled environments.

The detailed descriptions of the above embodiments are not exhaustive descriptions of all embodiments contemplated by the inventors to be within the scope of the present description. Indeed, persons skilled in the art will recognize that certain elements of the above-described embodiments may variously be combined or eliminated to create further embodiments, and such further embodiments fall within the scope and teachings of the present description. It will also be apparent to those of ordinary skill in the art that the above-described embodiments may be combined in whole or in part to create additional embodiments within the scope and teachings of the present description.

Thus, although specific embodiments are described herein for illustrative purposes, various equivalent modifications are possible within the scope of the present description, as those skilled in the relevant art will recognize. The teachings provided herein can be applied to other connectors with latches, and not just to the embodiments described above and shown in the accompanying figures. Accordingly, the scope of the embodiments described above should be determined from the following claims.

We claim:

1. A connector (100), comprising:

a connector body (110) with a connector axis (X), the connector body (110) being comprised of:

an interface (112) at a first distal end (110*a*) of the connector body (110);

an opening (114) at a second distal end (110*b*) of the connector body (110); and a conduit (116) extending from the interface (112) to the opening (114) along the connector axis (X);

a latch (120) that moves relative to the connector body (110) to selectively engage a plug connector (200), the latch (120) being comprised of:

a pivot end (122) coupled to the connector body (110);

a manually operable end (124); and a latching feature (126) disposed between the pivot end (122) and the manually operable end (124); and a plate (140) coupled to the first distal end (110*a*) of the connector body (110) and directly attached to the pivot end (122) of the latch (120), the plate (140) comprising a surface (W) that is substantially perpendicular to the connector axis (X), wherein at least a portion of the connector body (110) and at least a portion of the latch (120) are formed as a single integral piece of material.

2. The connector (100) of claim 1, wherein the latch (120) is pivotable about the pivot end (122) when a force is applied to the manually operable end (124).

3. The connector (100) of claim 1, wherein the latch (120) is adapted to selectively engage the plug connector (200) with the latching feature (126).

4. The connector (100) of claim 1, wherein the latch (120) moves the latching feature (126) into or out of the connector body (110) to selectively engage the plug connector (200).

5. The connector (100) of claim 1, wherein the latch (120) has a latch length (Y) extending from the pivot end (122) to the manually operable end (124), wherein the latch length (Y) is substantially parallel to the connector axis (X) of the connector body (110).

6. The connector (100) of claim 1, wherein the brace (130) further comprises a brace length (Z) extending from the base end (132) and the bracing end (134), where the brace length (Z) is substantially parallel to the connector axis (X) of the connector body (110).

7. The connector (100) of claim 1, wherein the brace (130) limits the movement of the latch (120) to ensure that the latch (120) only elastically deforms.

8. The connector (100) of claim 1, wherein the connector body (110) further comprises a groove (116*a*) formed in the connector body (110).

9. The connector (100) of claim 1, further comprising a brace (130) comprised of:

a base end (132) coupled to the first distal end (110*a*) of the connector body (110); and a bracing end (134) that is proximate the manually operable end (124) of the latch (120).

10. A method of using a connector (100), the method comprising:

providing a connector body (110) with a connector axis (X), the connector body (110) being adapted to receive a plug connector (200) in a direction substantially parallel with the connector axis (X);

providing a latch (120) comprised of:

a pivot end (122) coupled to the first distal end (110*a*) of the connector body (110);

a manually operable end (124);

a latching feature (126) disposed between the pivot end (122) and the manually operable end (124)

providing a plate (140) coupled to the first distal end (110*a*) of the connector body (110) and directly attached to the pivot end (122) of the latch (120), the plate (140) comprising a surface (W) that is substantially perpendicular to the connector axis (X); and manually operating the latch (120) to selectively engage the latch (120) with a plug connector (200) in the connector body (110), wherein at least a portion of the connector body (110) and at least a portion of the latch (120) are formed as a single integral piece of material.

11. The method of using the connector (100) of claim 10, wherein the step of manually operating the latch (120) comprises pivoting the latch (120) about the pivot end (122) by applying a force to the latch (120).

12. The method of using the connector (100) of claim 10, wherein the step of manually operating the latch (120) comprises moving the latching feature (126) into or out of the connector body (110) to selectively engage the plug connector (200).

13. The method of using the connector (100) of claim 10, wherein manually operating the latch (120) comprises pressing the plug connector (200) against the latching feature (126).

14. The method of using the connector (100) of claim 10, wherein manually operating the latch (120) comprises pressing against the manually operable end (124) of the latch (120).

15. The method of using the connector (100) of claim 10, wherein the operator moves the latch (120) towards the brace (130) until the brace (130) stops the movement of the latch (120) to ensure that the latch (120) only elastically deforms.

16. The method of using the connector (100) of one claim 10, wherein the step of pivoting the latch (120) about the pivot end (122) comprises utilizing the elasticity of the latch (120) to move the latching feature (126) towards the connector body (110).

17. The method of using the connector (100) of claim 10, wherein moving the latching feature (126) to engage the plug connector (200) retains the plug connector (200) within the connector body (110).

18. The method of using the connector (100) of claim 10, further comprising providing a brace (130) coupled to the connector body (110), wherein the brace (130) comprises a bracing end (134) that is proximate the manually operable end (124) of the latch (120), wherein the operator braces against the bracing end (134) while pressing against the manually operable end (124) of the latch (120).

19. A method of forming a connector (100), the method comprising:

forming a connector body (110) adapted to receive a plug connector (200) in a direction substantially parallel to a connector axis (X) of the connector body (110); and forming a latch (120) comprised of:

a pivot end (122) coupled to the connector body (110);

a manually operable end (124); and a latching feature (126) disposed between the pivot end (122) and the manually operable end (124)

forming a plate (140) coupled to the first distal end (110*a*) of the connector body (110) and directly attached to the pivot end (122) of the latch (120), the plate (140) comprising a surface (W) that is substantially perpendicular to the connector axis (X); and wherein at least a portion of the connector body (110), at least a portion of the latch (120), plate (140) are formed as a single integral piece of material and wherein the latch (120) is adapted to elastically deform when the latch (120) moves relative to the connector body (110).

20. The method of forming the connector (100) of claim 19, wherein the step of forming the connector body (110) comprises forming an interface (112) at a first distal end (110*a*) of the connector body (110), wherein the interface (112) and the at least the portion of the connector body (110) are formed as a single integral piece of material.

21. The method of forming the connector (100) of claim 19, wherein the step of forming the interface (112) comprises encapsulating at least a portion of a pin (150) that extends through the interface (112).

22. The method of forming the connector (100) of claim 19, further comprising:

forming a brace (130) with:

a base end (132) that is coupled to the connector body (110); and a bracing end (134) that is proximate the manually operable end (124) of the latch (120); and wherein at least a portion of the brace (130), the at least the portion of the latch (120), and the at least the portion of the connector body (110) are formed as the single integral piece of material.

* * * * *